US008432093B2

(12) United States Patent
Thomas

(10) Patent No.: US 8,432,093 B2
(45) Date of Patent: Apr. 30, 2013

(54) RUGGEDIZED LAMP CONSTRUCTION, AND METHOD

(75) Inventor: Leonard A. Thomas, Fairport Harbor, OH (US)

(73) Assignee: EYE Lighting International of North America, Inc., Mentor, OH (US)

( * ) Notice: Subject to any disclaimer, the term of this patent is extended or adjusted under 35 U.S.C. 154(b) by 168 days.

(21) Appl. No.: 13/106,338

(22) Filed: May 12, 2011

(65) Prior Publication Data

US 2011/0279010 A1 Nov. 17, 2011

Related U.S. Application Data

(60) Provisional application No. 61/334,440, filed on May 13, 2010.

(51) Int. Cl.
*H01J 1/88* (2006.01)
*H01J 19/42* (2006.01)
*H01J 9/00* (2006.01)

(52) U.S. Cl.
USPC ..... 313/238; 313/25; 313/253; 313/252; 313/318.01; 445/23; 445/26

(58) Field of Classification Search ..... 313/25, 313/238–294, 26, 317–318.12, 594, 607; 445/22, 23, 26, 27
See application file for complete search history.

(56) References Cited

U.S. PATENT DOCUMENTS

| | | | | |
|---|---|---|---|---|
| 3,623,134 | A | 11/1971 | Werner et al. | |
| 3,753,018 | A * | 8/1973 | Beijer et al. | 313/25 |
| 3,982,154 | A * | 9/1976 | Mize et al. | 315/234 |
| 4,195,251 | A | 3/1980 | Bamberg | |
| 4,491,766 | A * | 1/1985 | Larson | 315/60 |
| 4,888,517 | A * | 12/1989 | Keeffe et al. | 313/25 |
| 4,990,819 | A | 2/1991 | Narby et al. | |
| 5,065,069 | A | 11/1991 | Hunter | |
| 5,532,543 | A | 7/1996 | Van Der Leeuw et al. | |
| 6,929,385 | B2 | 8/2005 | Gordin et al. | |

FOREIGN PATENT DOCUMENTS

WO WO 9118413 A1 * 11/1991

* cited by examiner

*Primary Examiner* — Mariceli Santiago
(74) *Attorney, Agent, or Firm* — D.A. Stauffer Patent Services LLC

(57) ABSTRACT

An arc tube light source supported by a discontinuous two-part (top and bottom) frame inside a bulb of an HID lamp is ruggedized to reduce weld breakage under vibration and shock. Each of the top and bottom frames is substantially U-shaped, with the open end of the U-shape being attached by a strap to a pinch of the arc tube. For ruggedization a bracing strap is fixed to, and extends between, two sides of the frame and is welded to a lead wire extending from the pinch. Strength is enhanced if two lead wires extend from the pinch, and the bracing strap is welded to both. Advantageously the two lead wires are sides of a U-shaped wire such as a "U-pin". Further stabilization may be achieved by using braces attached to both of the top and bottom frames and extended out against surrounding parts of the bulb.

20 Claims, 7 Drawing Sheets

RUGGEDIZED LAMP CONSTRUCTION, AND METHOD

TECHNICAL FIELD

The invention relates to lamps and, more particularly, to lamps having an encapsulated light source, particularly a two-ended (electrodes at two opposite ends rather than two electrodes at the same end) type of light source, such as a filament (which may be in its own enclosure) or an arc tube of a high intensity discharge (HID) lamp, and to "mount" structures for mounting the two-ended light sources within an outer envelope (or "bulb").

BACKGROUND

Some lamps comprise an encapsulated light source mounted by brackets, braces, straps and the like within an outer envelope (bulb). The encapsulated light source may comprise a filament tube or an arc tube, and may be of the "two-ended" type having at least one terminal (or electrode, or lead wire) at each of two opposite ends of the encapsulated light source. The two-ended light source may comprise a filament, which may be enclosed. In the main hereinafter, high intensity discharge (HID) lamps having an arc tube may be described, as exemplary of such lamps having two-ended light sources.

A high-intensity discharge (HID) lamp is a type of electrical lamp having a two-ended encapsulated light source, such as an "arc tube" containing a mixture of gases. The arc tube may be suspended (held in place) by various mechanical elements (such as clips, frames, straps, braces, brackets, etc., which collectively may be referred to as the "mount") inside a translucent or transparent protective outer envelope ("bulb"). The bulb may be somewhat cylindrical, having a "dome" at one end (which may be referred to as the top end) and a "neck" portion at the other end (which may be referred to as the bottom end). The top end of the bulb is generally sealed (not open). A separate "stem" element may be provided at the open, bottom end of the bulb, sealing the bottom end of the bulb. A "base" may be provided at the bottom end of the bulb, such as for screwing the lamp into a socket for mounting and providing electrical current (from an outside source) to the lamp. Electrical current is provided via the base, via various elements of the mount (and or a "fly wire") to terminals or electrodes of the arc tube.

The arc tube is typically elongated, having two opposite ends, and has electrodes (or terminals, or lead wires) at its two ends. Electricity is applied to these electrodes to create (start, initiate) and to sustain a plasma (or discharge) in the arc tube. Generally, a higher voltage may be required to start the plasma than to sustain it. There are generally two categories (or types) of HID lamp that will be discussed herein:

(i) "pulse-start", having only two distinct electrodes, one at each end of the arc tube, and which may use an igniter located in a ballast pod, external to the lamp, to start the lamp (initiate the plasma).

(ii) "probe-start", which uses an additional electrode in the form of a starting probe (or "starter wire", or "starter lead") at one of the ends of the arc tube (typically at the bottom end) to facilitate starting the lamp. A simple starting (or starter) circuit such as comprising an inductor and a bimetallic switch may be located within the bulb for initiating the plasma in the arc tube, and the proximity of the starter wire to the electrode at the same end of the arc tube facilitates initiating the plasma. Once the plasma is started, heat generated by the arc tube may cause a bimetallic switch in the starter circuit to open, thereby terminating flow of electric current through the starter wire.)

FIG. 1 illustrates the construction of an exemplary HID (High intensity Discharge) lamp 100 of the prior art. The lamp 100 is illustrated in a generally vertical orientation, or "base-down", although it may be inverted or held horizontal in use (such as for overhead lighting applications). In some of the descriptions set forth herein, terms such as "top" and "bottom" may be used to describe the location or position of various elements, such as relative to other elements, and should be evident from the drawings. Other terms such as "left" and "right", or "front" and "back" may also be used to indicate relative positions of elements as viewed in a referenced drawing figure.

A generally cylindrical arc tube 110 (or capsule) has two end portions 110*a* and 110*b*, a central ("chamber") portion 110*c* between the end portions 110*a* and 110*b*, a length and diameter, and contains one or more gases which, when excited by an appropriate electrical current arcing through the gases, produce light. The end portions 110*a* and 110*b* of the arc tube 110 may be flattened ("pinched") to seal around one or more electrical conductors passing therethrough, and may be referred to as "pinches". The central portion 110*c* remains generally cylindrical, and is hollow to contain the gas(es) in a closed chamber.

As is known in the lamp-making arts, other light sources are provided in similarly fashioned capsules which may also be similarly mounted in an outer envelope—for example high pressure halogen atmospheres are contained along with an incandescent filament in a capsule that may be called a filament tube. Therefore, although the present disclosure is focused on an arc tube embodiment of an encapsulated light source, that should be treated as an exemplary embodiment of an encapsulated light source which may be held in a mount structure according to the present invention, as will be disclosed hereinbelow.

At both the top and bottom ends (not specifically labeled) of the arc tube 110, a lead wire (or electrode) extends from external to the arc tube 110, through the respective pinch 110*a* and 110*b*, to the interior 110*c* of the arc tube. The portion of the lead wire external to the arc tube 110 may be referred to specifically as a "lead wire", and the portion of the lead wire internal to the arc tube 110 may be referred to specifically as the "electrode". (A similar, additional separate "starter lead" or "probe lead" may also be provided at one end of the arc tube 110, as described below, for probe-start type HID lamps.)

The arc tube may have a band of white coating surrounding the electrodes on one, or both, ends of the arc tube. The coating reflects the heat from the arc and electrode back into the bottom of the end-chamber where the chemicals settle when the arc tube cools. This additional heat helps to vaporize the chemicals into a gas so that they will enter into the arc stream. The vaporized chemicals fuel the arc making it very strong and brilliant. The white coating material may stay white through the lamp life, maintaining optimum end-chamber temperature and resulting in superior lumen maintenance and color consistency.

The arc tube lead wires may be provided in the form of U-pins (U-shaped elements). Generally, any "U-shaped" element may be described as having two "side" or "leg" portions (or simply "legs", or "sides") extending substantially parallel (and coplanar) with one another and joined at a common end to each other by a "bow" (or "bend", or "bight") portion (or simply "bow", "bend" or "bight").

A U-pin 112 is shown extending into the top pinch 110*a* of the arc tube 110. A U-pin 114 is shown extending into the bottom pinch 110*b* of the arc tube 110. The bight portions of the U-pins 112 and 114, including a portion of their respective leg portions (or sides), are external to the arc tube 110, and serve as lead wires. Remaining portions of the legs of the U-pins 112 and 114 extend into the respective pinch 110*a* and 110*b*, where they are welded to a thin metal foil which is sealed in the pinch. On the interior side of the pinch, an electrode wire/shank is also welded to one of the foils and extends into the interior of the arc tube, to serve as electrodes, in contact with gas(es) contained in the central portion 110*c* of the arc tube 110. The U-pins 112 and 114 may be formed of wire, such as approximately 0.6 mm (0.020 inch) diameter molybdenum wire.

The U-pins 112 and 114 may also serve a mechanical function. Generally, the U-pin construction with two legs embedded in the pinch of the arc tube may provide a sturdier mechanical interface with the arc tube than would otherwise be realized if only a single pin (lead wire) were to be embedded in the pinch.

The U-pins 112 and 114 also serve as terminals, or electrodes, for providing electrical current to the gases inside the arc tube to initiate and sustain the plasma discharge. For a pulse start lamp, each U-pin connects to one of the two electrodes at opposite ends of the of the arc tube. For a probe start lamp, one of the U-pins, such as the bottom U-pin 114 may be cut (or clipped, such as in half, at the bight) so that one leg of the U-pin constitutes an electrode lead wire (as before), and the other leg is connected to a "starter" or "probe" wire for starting the discharge in the arc tube. This may be referenced as a probe lead wire. Details of a cut bottom U-pin will be shown and described below (FIG. 3B).

In a finished lamp, a protective outer envelope (bulb) 120 surrounds the arc tube 110 which is located and supported more-or-less centrally within the bulb 120 by a "mount structure" 130 comprising various metal wires, frames, bands and straps, as may be described in greater detail hereinbelow. Mechanical and/or electrical connections or attachments of metal components one to another is typically accomplished by welding, but other connection means are possible, therefore the term "welded" should be considered as including other suitable and comparable attachment means within its scope.

The bulb 120 is elongate, somewhat "pear shaped", having an overall length "L", is initially open at one end (the bottom end), and has three main portions. A top end portion of the bulb 120 may be referred to as a "dome" portion 122 of the bulb 120. The dome portion 122 may constitute approximately 10% of the overall length "L" of the bulb 120, and is closed. An opposite, bottom end portion of the bulb 120 may be referred to as a "neck" portion 124 of the bulb 120. The neck portion 124 may constitute approximately 20% of the overall length "L" of the bulb, and is initially open (but will be sealed with the "stem", described hereinbelow). Both of the neck and dome portions 122 and 124 are generally cylindrical, each having a diameter of approximately "D1". A central portion 126 (or "bulb portion") of the bulb 120 is disposed between the neck and dome portions 122 and 124. The central portion 126 may constitute approximately 70% of the overall length "L" of the bulb 120, and may have a diameter "D2" greater than "D1", which gives the bulb 120 its characteristic "pear shaped" (bulbous) appearance. For example, "D2" may be approximately twice as large as "D1" (D2~=2*D1), and "L" may be approximately twice as large as "D2" (L~=2*D2). The length "x" of the arc tube 110 may be approximately 60% of the overall length "L" of the bulb 120, and the diameter "d" of the arc tube 110 may be approximately 50% of the smaller (neck, dome) diameter "D1" of the bulb 110. As an example, the overall length "L" of the bulb may be approximately 30 cm (12 inches). In other examples, the bulb length may range between 21-38.5 cm.

A mount structure 130 supports the arc tube 110 within the bulb 120, and also delivers electrical current from the base of the lamp (described below) to the lead wires (essentially, the U-pins 112 and 114, or portions thereof) for the electrodes of the arc tube 110.

The mount structure 130 includes a "top" U-shaped frame 132 disposed in the bulb 120 and extending from within the dome portion 122 into the central portion 126 and a similar "bottom" U-shaped frame 134 disposed in the bulb 120 and extending from within the neck portion 124 into the central portion 126. The top and bottom frames 132 and 134 may be considered to be two parts of a discontinuous two-part frame. The top and bottom frames 132 and 134 may be formed of wire (and may be referred to as "wire frames"), such as approximately 1.6 mm (0.060 inch) diameter stainless steel rod material.

The top U-shaped frame 132 comprises two legs portions (or sides) 132*a* and 132*b* extending parallel with one another and joined at one end by a bow (or bend, or bight) portion 132*c*. Similarly, the bottom U-shaped frame 134 comprises two legs portions (or sides) 134*a* and 134*b* extending parallel with one another and joined at one end by a bow (or bend, or bight) portion 134*c*. The top and bottom frames 132 and 134 may be substantially coplanar with one another, and may be substantially coplanar with the U-pins 112 and 114. The U-shaped frames 132 and 134 are larger than the U-shaped U-pin elements 112 and 114.

The two legs 132*a* and 132*b* of the top frame 132 may extend longitudinally downward, slightly beyond the top pinch end 110*a* of the arc tube 110, generally parallel to the axis of the (cylindrical) arc tube 110, and spaced a small (radial) distance away from (adjacent to) the arc tube 110—in other words, extending adjacent the arc tube 110 adjacent opposite sides thereof. A pair of metal pinch straps (or braces) 142*a* and 142*b* (which may collectively be referred to as "142") extend across the top pinch 110*a* (on opposite sides thereof), from leg-to-leg of the top frame, and may be fixed (such as by welding) to the two legs 132*a* and 132*b* of the top frame 132, thereby securing a top portion of the arc tube 110 in the mount structure 130.

In a similar manner, the two legs 134*a* and 134*b* of the bottom frame 134 may extend longitudinally upward, slightly beyond the bottom pinch end 110*b* of the arc tube 110, generally parallel to the axis of the (cylindrical) arc tube 110, and spaced a small (radial) distance away from (adjacent to) opposite sides of the arc tube 110. A pair of metal pinch straps (or braces) 144*a* and 144*b* (which may collectively be referred to as "144") extend across the bottom pinch 110*b* (on opposite sides thereof), from leg-to-leg of the bottom frame 134, and may be fixed (such as by welding) to the two legs 134*a* and 134*b* of the bottom frame 134, thereby securing a bottom portion of the arc tube 110 in the mount structure 130.

A person of ordinary skill in the related lamp-making and design arts will understand that the references herein to a "pinch strap" (in the singular) is intended to encompass various forms such as, for example, a single ribbon of strapping metal that is wrapped around the pinch; and such as, for example, a pair of ribbons that sandwich the pinch and are attached together (in various ways, e.g., welding) at the two sides of the pinch.

As illustrated, the legs of the top and bottom frames 132 and 134 extend towards each other, and may extend at least to (and possibly slightly beyond) the respective pinches 110*a* and 110*b* of the arc tube 110. The leg 132*a* of the top frame 132 may be in line with the leg 134*a* of the bottom frame 134, and the leg 134*b* of the top frame 134 may be in line with the leg 134*b* of the bottom frame 134. However, the top and bottom frames 132 and 134 are physically and electrically separated from one another, and neither extends longitudinally to adjacent the central portion 110*c* the arc tube 110. It is generally not desirable that any portion of the mount structure 130 be located adjacent the central portion 110*c* of the arc tube. (A "fly wire", described hereinbelow, may pass by the central portion 110*c* of the arc tube 110, at a suitable distance therefrom.)

A pair of top frame braces (or "supports") 136*a*, 136*b* (which may collectively be referred to as "136") are disposed in the dome portion 122 of the bulb 120 to support the top wire frame 132. The braces (supports) 136 may each may comprise an elongated metal strip having a length of approximately "D1" and may extend at right angles with respect to a plane defined by the top wire frame 132. One brace 136*a* may be fixed (such as by a weld) to one of the legs (or sides) of the wire frame 132, at a longitudinal position near the bight end of the top wire frame 132. The other brace 136*b* may similarly be fixed (such as by a weld) to the other leg (or side) of the wire frame 132, at a longitudinal position near its bight end. The ends of the frame braces 136*a* and 136*b* may be slightly bent and/or dimpled, so as to be "snugly" received within the dome portion 122 of the bulb 120 to stabilize the top frame 132 in the dome portion 122 of the bulb 120. The top frame braces 136*a* and 136*b* serve a mechanical function, and may be formed of sheet metal, such as 0.5 mm (0.020 inch) thick spring steel material.

U.S. Pat. No. 4,990,819, incorporated by reference herein, discloses a HID lamp having a canted arc tube with rotary locking joints, and discloses what appears to be a set of frame braces (not numbered) similar to the braces 136*a* and 136*b* in the dome portion of the bulb and a set of similar looking bottom frame braces (also not numbered) in the neck portion of the bulb.

Referring again to the prior art shown in FIG. 1, a metal strap or wire 152 may extend between the leg 132*b* of the top frame 132 to a leg of the top U-pin 112, for conducting electrical current from the frame 132 to the arc tube 110. A metal strap or wire 154 may extend between the leg 134*b* of the bottom frame 134 to a leg of the bottom U-pin 114, for conducting electrical current from the frame 134 to the arc tube 110. This is representative of a pulse-start type HID lamp.

A stem component 160 may be formed of glass (or the like), and may have a diameter approximately equal to the diameter "d" of the arc tube 110, which is less than the diameter "D1" of the neck portion 124 of the bulb. Two stem leads 162 and 164 protrude from the top of the stem component 160. A base component 166, such as a conventional screw-type base (for screwing the lamp into a socket) is disposed around a bottom part of the stem component 160. Leads (not shown) within and exiting the bottom of the stem component 160 electrically connect the stem leads 162 and 164 to the base component 166.

The base component essentially comprises a shell (formed with screw threads), a ceramic insulator, and an eyelet (or button) extending from the bottom. The shell may be nickel-plated brass. The shell and the eyelet constitute what may be considered to be two "terminals" for the overall device (i.e., the lamp).

The bight portion 134*c* of the bottom frame 134 may be fixed (such as welded) to the stem lead 164. This provides support for the bottom frame 134, hence the arc tube 110, and the top frame 132 attached thereto. Also, the connection of the bottom frame 134 to the stem lead 164 provides electrical current from the base component 166, via the bottom frame 134, via the bottom strap (wire) 154, via the U-pin 114 to the arc tube 110.

A "fly wire" 158 may extend from the other stem lead 162 to a leg 132*b* of the top frame 132 to provide electrical current from the base component 166, via the top frame 132, via the top strap (wire) 152 via the U-pin 112 to the arc tube 110. The example set forth herein is representative of a pulse-start type HID lamp. For a probe-start type HID lamp, a starting circuit (not shown) may be located in the neck portion 124 of the bulb 120, near the stem component 160, and a separate probe lead would be provided, as is known, and as is described hereinbelow.

U.S. Pat. No. 3,623,134, incorporated by reference herein, illustrates a lamp having a unitary (one-piece), generally rectangular frame, rather then the two-piece frame comprising separate top and bottom frame elements 132 and 134, as disclosed herein. Generally, a unitary frame would be more rugged, but there are disadvantages to having a portion of the frame located abreast of the central portion 110*c* of the arc tube 110.

FIGS. 1A and 1B illustrate the lamp 100 with the arc tube 110 supported in the bulb 120 between the separate (rather than unitary) top and bottom frame elements 132 and 134, the pinch straps 142 and 144 on respective pinches 110*a* and 110*b* of the arc tube 110, the stem component 160, the stem leads 162 and 164, and the base component 166. The fly wire 168 from the stem lead 162 to the top frame 132 is omitted, for illustrative clarity, and since it does not form part of the mount structure (130) per se.

In FIG. 1A, the top and bottom frames 132 and 134 are aligned with one another. Since the top and bottom frames 132 and 134 are not a unitary structure (compare the one-piece rectangular frame in U.S. Pat. No. 3,623,134), this allows for some distortion, bending, pivoting, misalignment and/or breakage of welds, stem, or arc tube pinches when the lamp is subjected to vibration and/or mechanical shock. The articulated frame arrangement in U.S. Pat. No. 4,990,819 may address and alleviate such problems, albeit with added complexity.

In FIG. 1B, the top and bottom frames are shown misaligned, such as may result from vibration or mechanical shock. Such misalignment can lead to failure of welds and/or cracking (not shown) of the glass stem 160, ultimately in failure of the lamp 100. Note the severe misalignment where the top and bottom frames 132 and 134 are welded to the top and bottom pinch straps 132 and 134, respectively. Resulting stress is likely to result in breakage of the welds, and consequent failure of the lamp 100. Also likely to happen is a broken weld of the bottom frame 134 to the stem lead 164. These problems can result not only in mechanical failure, but also the breaking of these welds may interrupt the flow of electrical current to the arc tube (light source) 110.

It is an object of the present invention to provide an improved mount structure and method of mounting for encapsulated light sources such as are in HID lamps (or the like), particularly those having separate top and bottom frames, the improvements making the lamp more rugged (or ruggedized) by improving shock and vibration resistance, and reducing some opportunities for lamp failure.

SUMMARY

It is an object of the invention to provide an improved construction for lamps, particularly lamps having a two-ended encapsulated light source disposed within a bulb, thereby providing improved shock and vibration resistance. The two-ended encapsulated light source may comprise an arc tube or a filament, with electrodes at opposite ends. In the main hereinafter, high intensity discharge (HID) lamps having an arc tube will be described, as exemplary of various embodiments of the invention. The improvements disclosed herein generally pertain to modifications or additions to the mount structure (straps, braces, etc.) holding the arc tube in place within the bulb to make the lamp more "ruggedized" (such as resistant to shock and vibration distortion/damage).

An arc tube light source supported by a discontinuous two-part (top and bottom) frame inside a bulb of an HID lamp is ruggedized to reduce weld breakage under vibration and shock. Each of the top and bottom frames is substantially U-shaped, with the open end of the U-shape being attached by a strap to a pinch of the arc tube. For ruggedization a bracing strap is fixed to, and extends between, two sides of the frame and is welded to a lead wire extending from the pinch. Strength is enhanced if two lead wires extend from the pinch, and the bracing strap is welded to both. Advantageously the two lead wires are sides of a U-shaped wire such as a "U-pin". Further stabilization may be achieved by using braces attached to both of the top and bottom frames and extended out against surrounding parts of the bulb.

Generally, a mount structure supporting an arc tube in a bulb of an HID lamp is ruggedized to reduce weld breakage and to provide the possibility of welded elements remaining in electrical (and some mechanical) contact with one another even in the event of up to a few welds breaking. For example, U-pin braces extending from legs (sides) of the top and/or bottom frame elements may be "woven" through the two legs (sides) of the U-pins extending from ends of the arc tube and serving as its lead wires. In the case of a cut U-pin, such as in a probe-start type lamp, the brace may be woven around the single U-pin leg serving as the electrode lead, being woven with respect to two frame element legs, one on either side of the U-pin leg. This is stronger than prior art which only connects an arc tube lead to a single frame element leg using a wire to complete an electrical circuit.

Although the present disclosure may refer to arc tube lead wire(s) as "U-pin leads" or simply as a U-pin, and may refer to its brace as a "U-pin brace", such terms should be considered inclusive of one or more individual arc tube lead wires, but not necessarily equivalent, since the U-pin has added strength and rigidity due to the extra interconnection provided by the bight portion of the U-shape.

BRIEF DESCRIPTION OF THE DRAWINGS

Reference may be made to embodiments of the invention, non-limiting examples of which may be illustrated in the accompanying drawing figures (FIGs). Some elements in the figures may be exaggerated, others may be omitted, for illustrative clarity. Similar elements in various figures may be similarly numbered, such as element 215 being similar to element 115, where the most significant digit(s) of the reference numeral may correspond to the figure number (such as FIG. "2"). Terms of orientation such as "top", "bottom", "left", "right", "front", "back", and the like may be used to indicate relative positions of elements with respect to one another, or portions of a given element with respect to one another.

DETAILED DESCRIPTION

Various embodiments will be described to illustrate teachings of the invention(s), and should be construed as illustrative rather than limiting. Although the invention may be described in the context of various exemplary embodiments, it should be understood that it is not intended to limit the invention to these particular embodiments, and individual features of various embodiments may be combined with one another.

Figure 1:
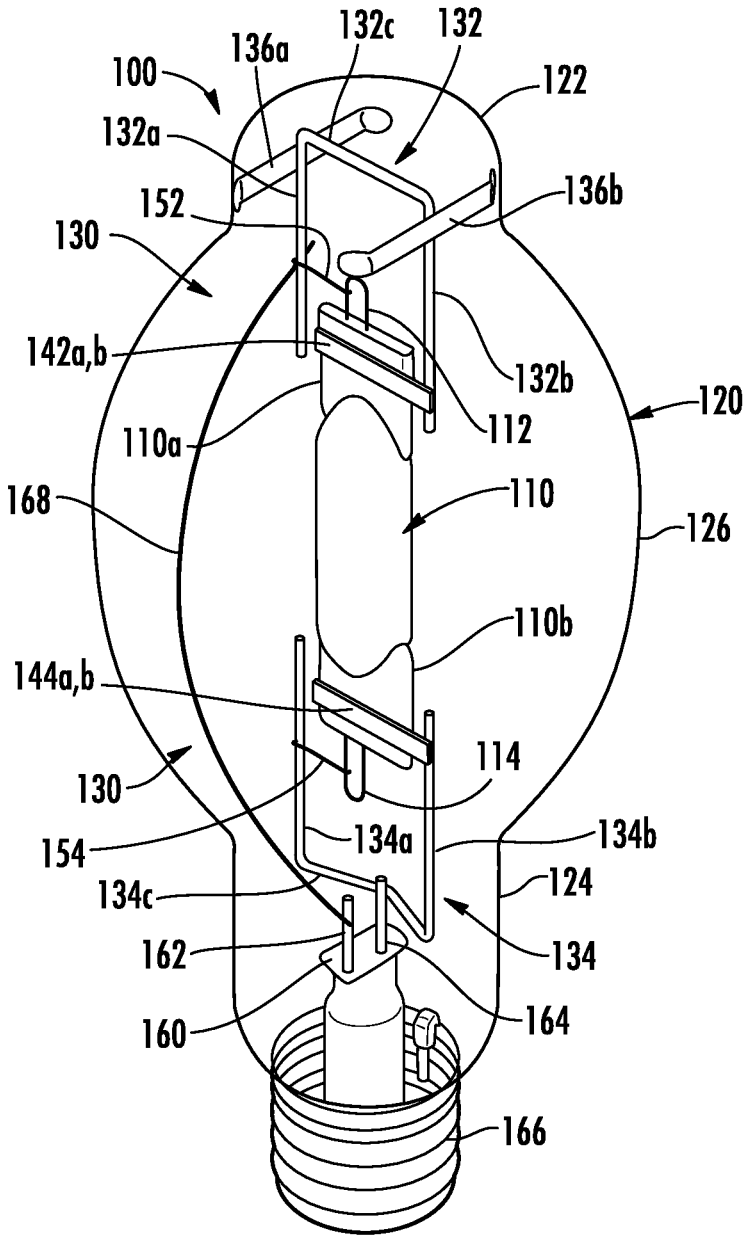
FIG. 1 (PRIOR ART)
FIG. 1 is a perspective view of a prior art lamp.
Figure 2:
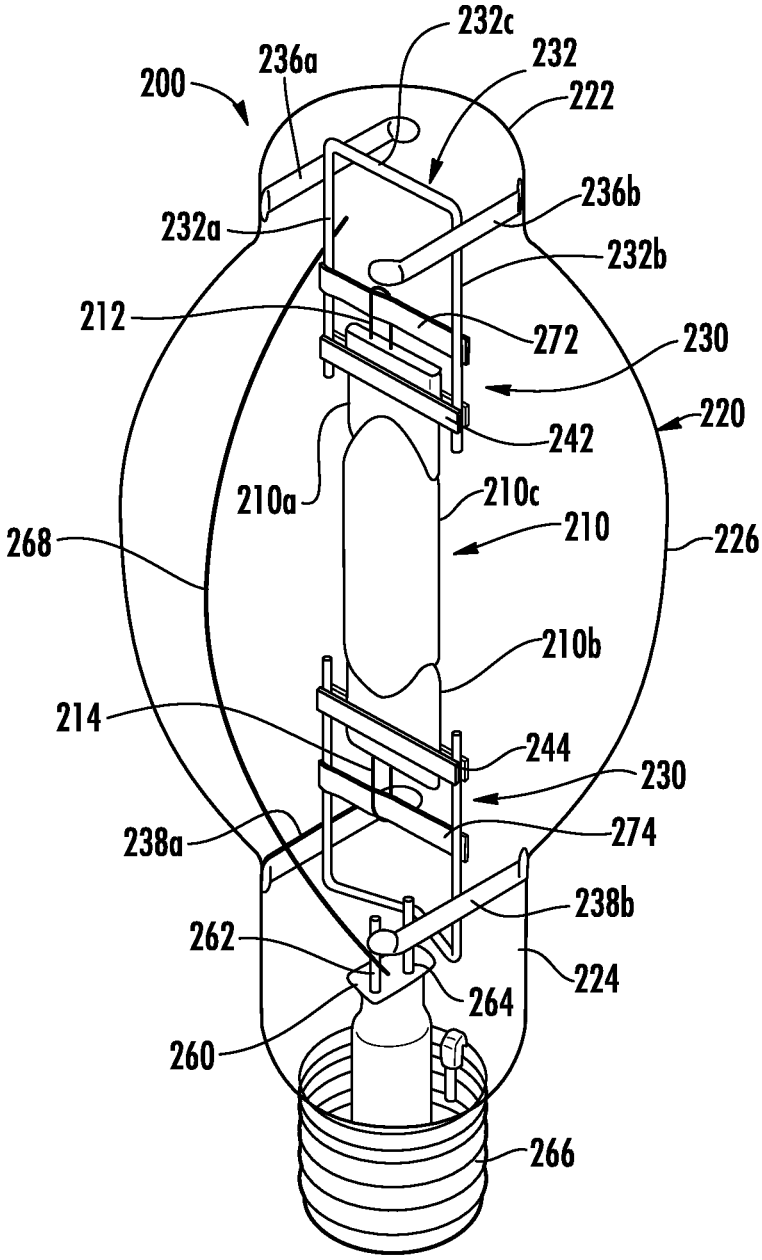
FIG. 2 is a perspective view of a lamp, illustrating some embodiments or features of the invention, which may be shown in greater detail in subsequent figures.

FIG. 2 shows a pulse-start type HID lamp 200 and illustrates various features or embodiments of the invention, some of which will be discussed in greater detail hereinbelow. The lamp 100 illustrated in FIG. 1 and the lamp 200 illustrated in FIG. 2 are both representative of pulse-start type lamps. Many of the features of the pulse-start type lamp 200 are applicable to probe-start type lamps which may be described below, for example with respect to FIG. 3B.

Generally, the lamp 200 comprises the following elements and features which may be similar (or identical) to those described with respect to the lamp 100, and therefore need not be discussed in detail, the previous description of similar (comparable) elements being referenced as though fully set forth herewith, namely:

- an arc tube 210 (compare 110) having top, bottom portions or "pinches" 210*a* and 210*b*, and a central portion 210*c;*
- a top U-pin 212 (compare 112) extending out of the top pinch 210*a;*
- a bottom U-pin 214 (compare 114) extending out of the bottom pinch 210*b;*
- a bulb 220 (compare 120) having a dome portion 222 (compare 122), a neck portion 224 (compare 124) and a central portion 226 (compare 126);
- a mount structure 230 (contrast 130) comprising a top U-shaped frame 232 (compare 132) and a bottom U-shaped frame 234 (compare 134), and other elements, details of which may be discussed hereinbelow;
- a pair of top frame braces 236*a* and 236*b* (compare 136*a* and 136*b*) which may collectively be referred to as "236" (compare 136);
- a pair of top pinch straps 242 (collectively) (compare 142*a* and 142*b*) extending across the top pinch 210*a* of the arc tube 210;
- a pair of bottom pinch straps 244 (collectively) (compare 144*a* and 144*b*) extending across the bottom pinch 210*b* of the arc tube 210;

a stem component 260 (compare 160) having two stem leads 262 and 264 (compare 162 and 164);

a base component 266 (compare 166); and a fly wire 268 (compare 168) extending from the stem lead 262 to the top frame 232.

Some features of the lamp 200 distinguishing (differentiating) the lamp 200 from the lamp 100 will now be discussed in detail, and reference may be made to subsequent figures (FIGS. 2A, 2B, 2C, 3A, 3B) which may show in greater detail some of these features as they may be applicable to pulse-start and/or to probe-start type lamps.

The lamp 200 may comprise a pair of bottom frame braces 238*a* and 238*b* (which may collectively be referred to as "238") which were not shown in the lamp 100 of FIG. 1. By having both top and bottom pairs of frame braces 236 and 238, the top part and the bottom part of the two-part frame (the top frame 232 and the bottom frame 234) are braced in position against inside walls of the bulb 220, in the dome and neck portions 222 and 224, respectively.

U.S. Pat. No. 4,990,819 has been referenced as showing bottom frame braces in an HID lamp, but it should be noted that the HID lamp in that patent has an articulated frame, and the top frame (analogous to the top frame 232) and bottom frame (analogous to the bottom frame 234) are not in line with one another. The top and bottom frames are not substantially coplanar. In the bulb 200 disclosed herein, the top and bottom frame elements 232 and 234 are substantially coplanar. The frame in the HID lamp of the patent is essentially one-piece, continuous, and continues alongside of the arc tube in manner which is specifically being avoided by the two-part, discontinuous frame described herein comprising separate, non-unitary top and bottom frames 232 and 234 (compare 132 and 134).

The pair of bottom frame braces 238 may be very similar (including substantially identical) to the pair of top frame braces 236, but they are disposed in the neck portion 224 of the bulb 220 (rather than in the dome portion 222) to support the bottom wire frame 234 (rather than the top wire frame 232). The braces 238 may each may comprise an elongated metal strip having a length of approximately "D1" and may extend at right angles with respect to a plane defined by the wire frame 234. One brace 236*a* may be fixed (such as by a weld) to one of the legs of the wire frame 234, near its bight. The other brace 236*b* may similarly be fixed (such as by a weld) to the other leg of the wire frame 234, near its bight. The ends of the frame braces 238*a* and 238*b* may be slightly bent and/or dimpled, so as to be "snugly" received within the neck portion 224 of the bulb 220 to stabilize the bottom frame 234 in the neck portion 224 of the bulb 220. The bottom frame braces 238*a* and 238*b* serve a purely mechanical function. The bottom frame braces 238 may be formed of the same material as the top frame braces 236.

The lamp 200 may comprise a top ribbon or strap of bracing material 272 extending from one leg (side) of the top frame 232 across the top U-pin 212 and to the other leg (side) of the top frame 232, and a bottom ribbon or strap of bracing material 274 extending from one leg (side) of the bottom frame 234 across the bottom U-pin 214 and to the other leg (side) of the top frame 232. The top and bottom straps 272 and 274 may be woven around or through the (one or) two sides (legs) of the top and bottom U-pins 212 and 214, respectively, and fixed (such as by welding) thereto, as described in greater detail hereinbelow, for example with respect to FIGS. 3A, 3B.

Generally, a probe-start type lamp can readily be distinguished from a pulse-start type lamp by virtue of the bottom U-pin of a probe-start type lamp being cut (clipped) so that there is both a lead wire and a starter lead extending into the bottom pinch of the arc tube. In other words, the two legs (sides) of the U-pin are not electrically shorted with one another when the U-pin is clipped. Also, a starting circuit (not shown) may be located within the bulb of a probe-start type lamp.

FIGS. 2A, 2B, 2C and 3A illustrate in greater detail some embodiments or features of the invention as they relate primarily to pulse-start type lamps. FIG. 3B illustrates in greater detail an embodiment or feature(s) of the invention as it relates particularly to a probe-start type lamp. Generally speaking, the features of various embodiments of the invention which will be described relate to improving the "ruggedness" of the lamp, thereby reducing mechanical and electrical failures of the lamp.

Figure 2A:
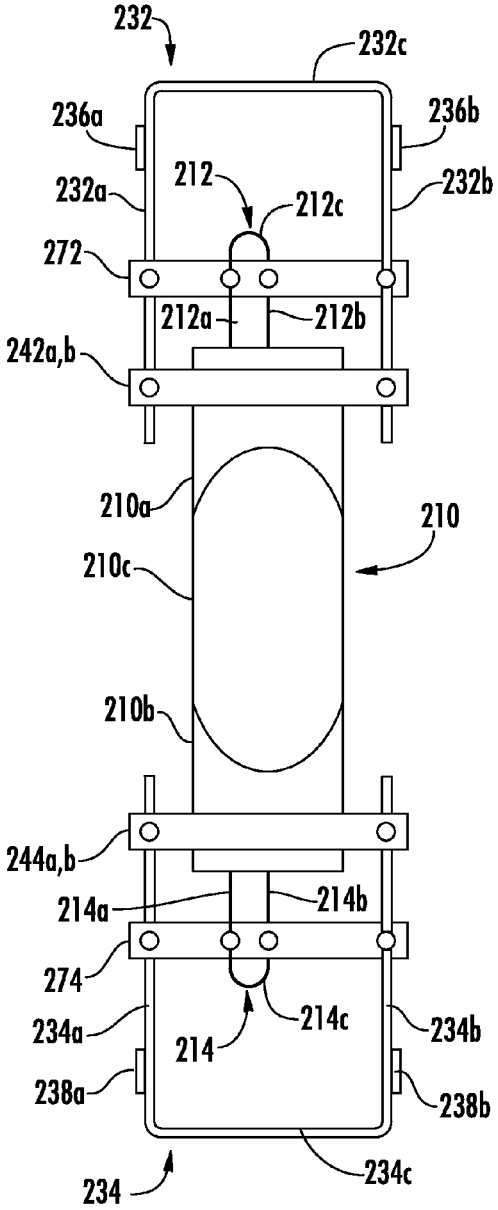
FIG. 2A is a diagram of a portion of a lamp, generally in front- or side-view, illustrating some embodiments or features of the invention.
Figure 2B:
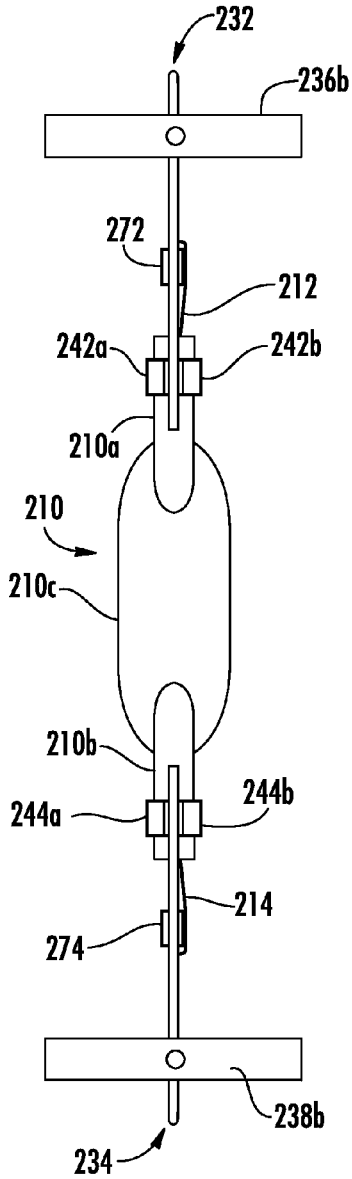
FIG. 2B is a diagram of a portion of a lamp, generally in a view perpendicular to that of FIG. 2A, illustrating some embodiments or features of the invention.

FIGS. 2A and 2B illustrate in greater detail, the arc tube 210, the top U-pin 212, the bottom U-pin 214, the top frame 232, the bottom frame 234, the pair (236) of top frame braces 236*a* and 236*b*, the pair (238) of bottom frame braces 238*a* and 238*b*, the top pinch straps 242*a* and 242*b*, the bottom pinch straps 244*a* and 244*b*. The circles represent areas where two elements may be joined together, such as by a weld (such as spot weld). The bulb 220, stem component 260 and base component 266 are omitted from the views of FIGS. 2A and 2B, for illustrative clarity.

The top U-pin 212 is U-shaped, comprising two substantially parallel (and coplanar) side (leg) portions 212*a* and 212*b*, connected at one end by a bow (or bight) portion 212*c*. The bottom U-pin 214 is U-shaped, comprising two substantially parallel (and coplanar) side (leg) portions 214*a* and 214*b*, connected at one end by a bow (or bight) portion 214*c*.

Note that the top and bottom U-pins 212 and 214 may be offset from center (off-center), so that one of their leads (legs) 212*b* and 214*b* may be substantially on-center with respect to a longitudinal axis of the arc tube 110. One U-pin may be offset in one direction, the other U-pin may be offset in the other direction. Both U-pins are shown offset in the same direction (to the left, as viewed), in the illustration of FIG. 2A. Additionally, as best viewed in FIG. 2B, the pinch straps 242*a/b* and 244*a/b* may wrap around the side edge(s) of the respective pinches 210*a* and 210*b*.

The top frame 232 is U-shaped, comprising two substantially parallel (and coplanar) leg portions 232*a* and 232*b*, connected at one end by a bow (or bight) portion 232*c*. The legs 232*a* and 232*b* are illustrated as extending downward, but do not extend past the pinch 210*a* so that they are not adjacent the central portion 210*c* of the arc tube 210.

The bottom frame 234 is U-shaped, comprising two substantially parallel (and coplanar) leg (side) portions 234*a* and 234*b*, connected at one end by a bow (or bight) portion 234*c*. The legs 234*a* and 234*b* are illustrated as extending upward, but do not extend past the pinch 210*b*. The legs 234*a* and 234*b* may extend slightly beyond the pinch 210*b*, but should not be adjacent the central portion 210*c* of the arc tube 210. (The same situation applies to the top frame 232 with respect to avoiding a portion of the frame being adjacent the central portion 210*c* of the arc tube 210.)

The top U-pin 212, bottom U-pin 214, top frame 232 and bottom frame 234 may be substantially coplanar with one another.

The pair (236) of top frame braces 236*a* and 236*b* are fixed to a longitudinal position which is at an upper (near the bight 232*c*) portion of the legs (sides) 232*a* and 232*b*, respectively, of the top frame brace 232, such as by spot welding (note the circle in FIG. 2B).

The pair (238) of bottom frame braces 238*a* and 238*b* are fixed to a longitudinal position which is at a lower (near the bight 234*c*) portion of the legs (sides) 234*a* and 234*b*, respectively, of the bottom frame brace 234, such as by spot welding (note the circle in FIG. 2B).

The top set of pinch straps 242*a* and 242*b* are fixed to a longitudinal position which is at a lower (distal from the bight 232*c*) portion of the legs 232*a* and 232*b*, respectively, of the top frame brace 232, such as by spot welding (note the circles in FIG. 2A).

The bottom set of pinch straps 244*a* and 244*b* are fixed to a longitudinal position which is at an upper (distal from the bight 234*c*) portion of the legs 234*a* and 234*b*, respectively, of the bottom frame brace 234, such as by spot welding (note the circles in FIG. 2A).

Figure 3A:
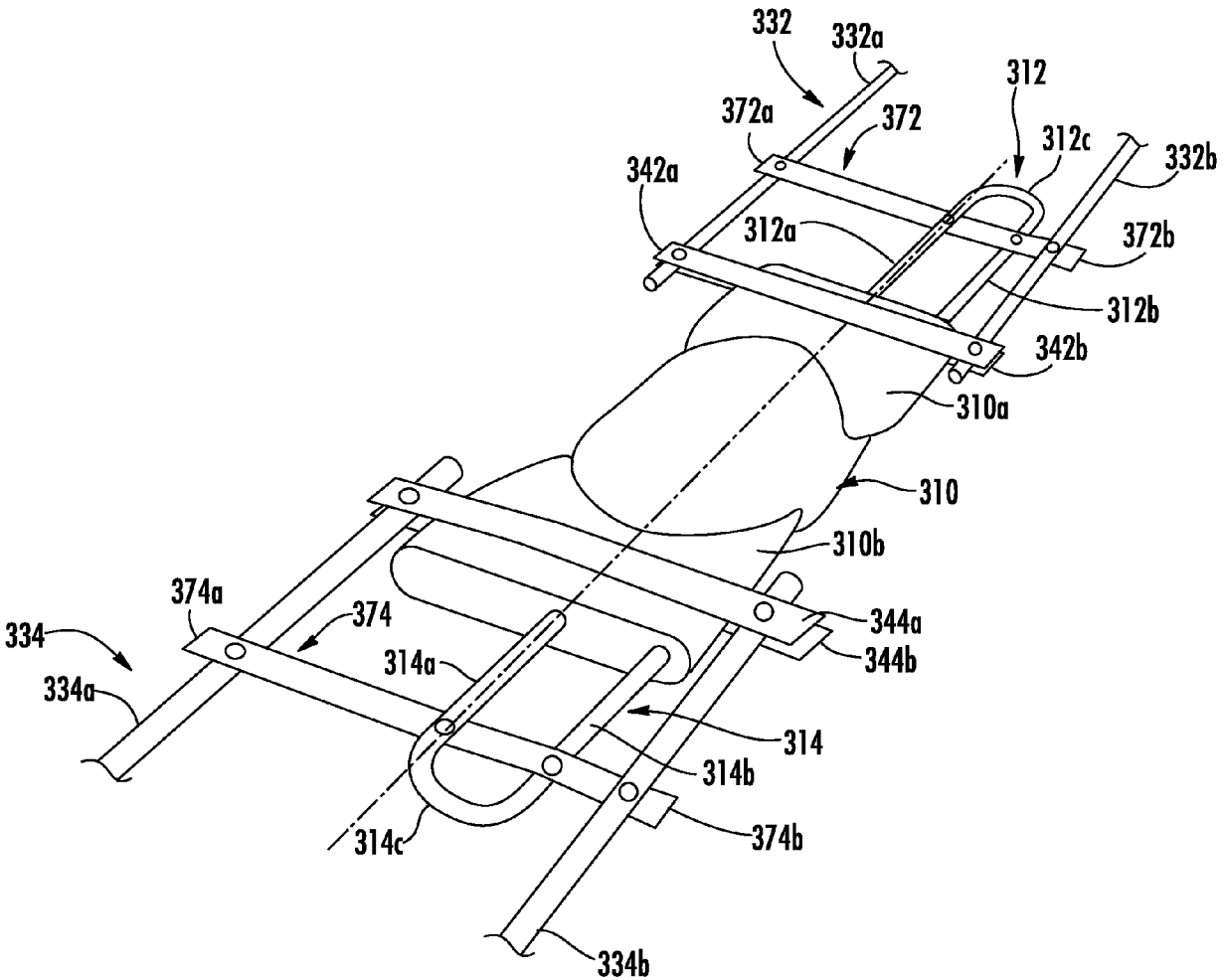
FIG. 3A is a diagram of a portion of a lamp, generally in perspective view, illustrating some embodiments or features of the invention.
Figure 3B:
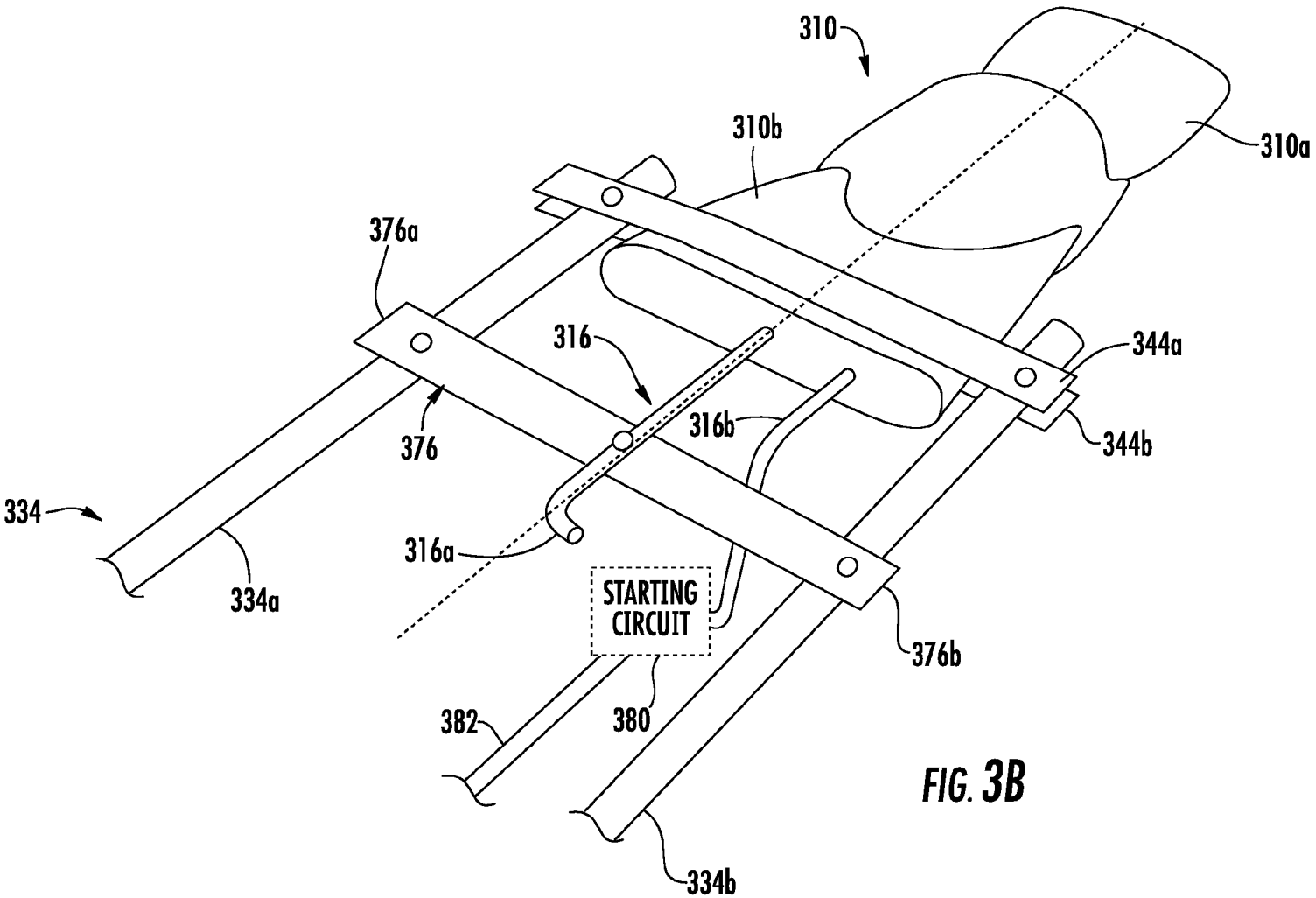
FIG. 3B is a diagram of a portion of a lamp, generally in perspective view, illustrating some embodiments or features of the invention.

A top ribbon or strap 272 extends from a longitudinal position which is at a middle portion (between the upper and lower portions) of the legs (sides) 232*a* and 232*b* of the top frame 232 to and through the top U-pin 212, as described in greater detail hereinbelow (FIG. 3A). A bottom ribbon or strap 274 extends from a longitudinal position which is at a middle portion (between the upper and lower portions) of the legs 234*a* and 234*b* of the bottom frame 234 to and through the bottom U-pin 214 as described in greater detail hereinbelow (FIG. 3A). The straps 272 and 274 may be referred to as "fastening straps" or "U-pin braces", may be formed of sheet metal, such as 0.4 mm (0.016 inch) thick stainless steel material.

Reference has been made herein to various elements attached (fixed, such as by welding) to various "longitudinal positions" of the legs (sides) of the top and bottom frame elements 232 and 234. The arc tube 210 is generally cylindrical, and has a longitudinal axis which may be coincident with a longitudinal axis of the bulb 220. The legs of the top and bottom frame elements extend parallel to the longitudinal axis (of the arc tube and bulb), and longitudinal position refers to positions along the length of the legs (sides) of the top and bottom frame elements.

To provide power to the arc tube 210, the bottom frame 234 may be mounted (such as welded) to the stem lead 264, and a fly wire (not shown) may extend from the stem lead 262 to the top frame 232. Electrical current is conducted from the top frame 232 to the top U-pin 212 by the top strap 272, and is conducted from the bottom frame 232 to the bottom U-pin 212 by the bottom strap 274. The bottom strap arrangement illustrated in FIGS. 2, 2A and 2B is exemplary of a pulse-start type lamp. A different arrangement for the bottom strap applicable to a probe-start type lamp is described hereinbelow with reference to FIG. 3B.

Figure 1A:
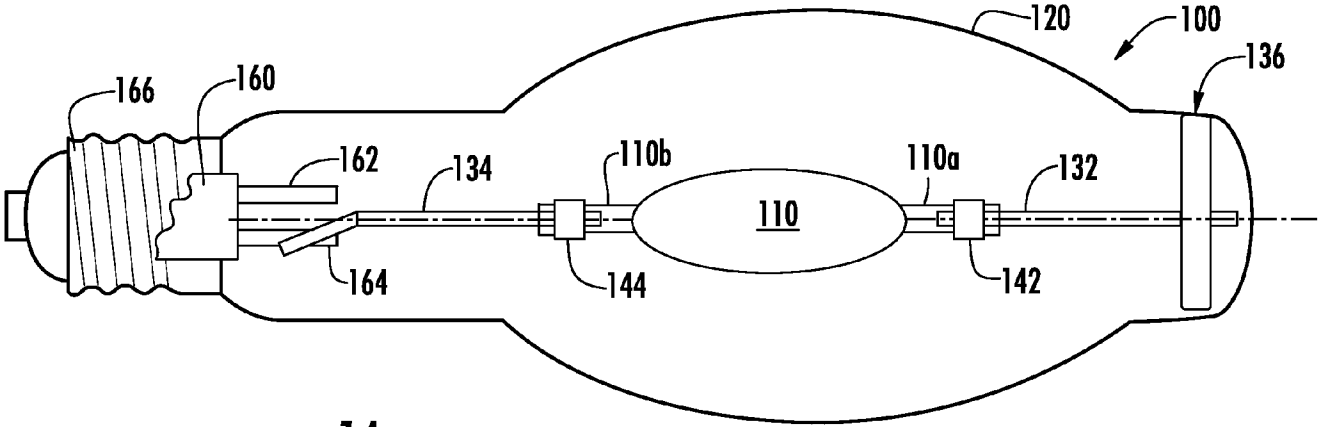
FIG. 1A (PRIOR ART)
FIG. 1A is a diagram with a portion of the base cut out to view the stem, of a prior art lamp.
Figure 1B:
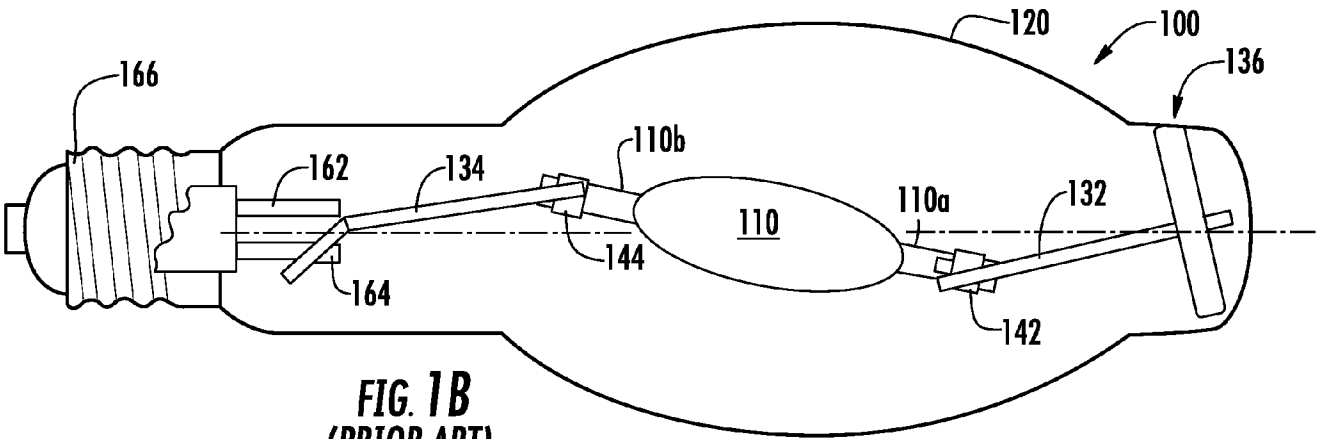
FIG. 1B (PRIOR ART)
FIG. 1B is a diagram with a portion of the base cut out to view the stem, of a prior art lamp.
Figure 2C:
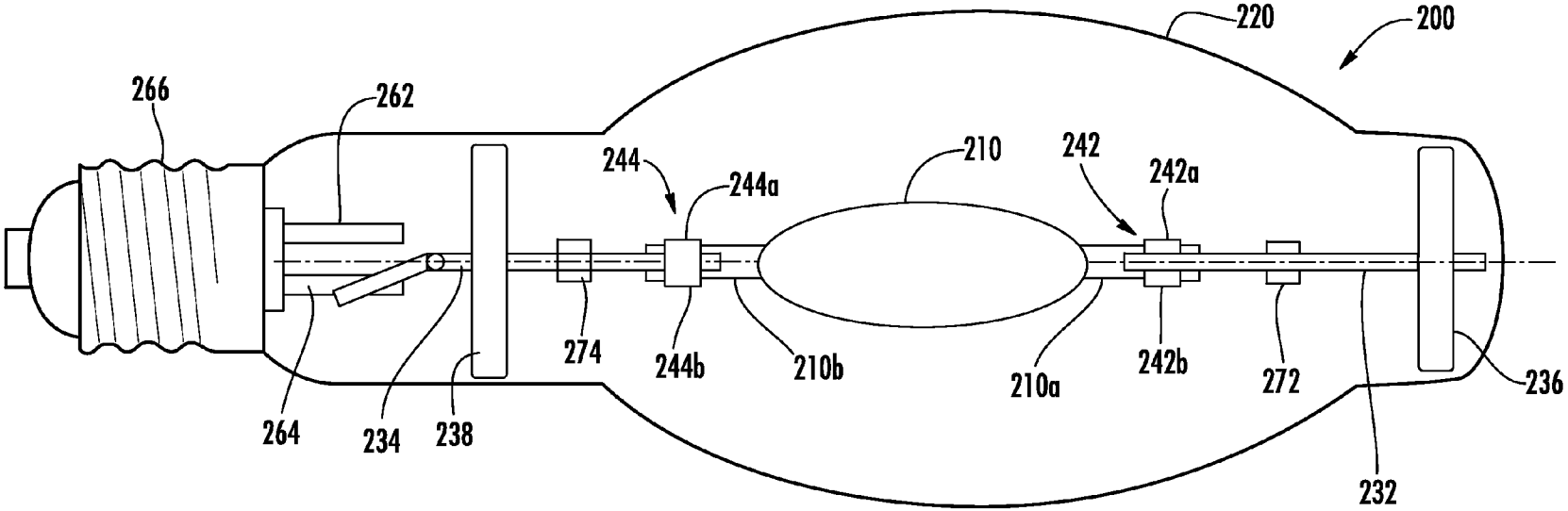
FIG. 2C is a diagram of a lamp, illustrating some embodiments or features of the invention.

FIG. 2C shows the lamp 200, and may be contrasted with FIGS. 1A and 1B as illustrating that the construction of the lamp 200 is more rugged than the construction of the lamp 100. Some similarities and differences will now be discussed.

Both of the lamps 100 and 200 have a pair of top frame braces 136 and 236, respectively. The lamp 200 has an additional pair (238) of bottom frame braces 238*a* and 238*b*).

Both of the lamps 100 and 200 have a pair of pinch straps 142*a,b* and 242*a,b* extending across the top pinch 110*a* and 210*a*, respectively, and both of the lamps 100 and 200 have a pair of pinch straps 144*a,b* and 244*a,b* extending across the bottom pinch 110*b* and 210*b*, respectively.

Both of the lamps 100 and 200 have an electrical conductor connected between the frame 132/134, 232/234 and an associated arc tube lead 112/114, 212/214, for the top/bottom structures respectively. The lamp 100 uses a wire conductor 152/154 between the lead wire and only one side of the frame, e.g., frame side 132*a*/134*a* as shown. The lamp 200 uses its novel top and bottom fastening straps 272 and 274 to additionally provide the electrical conductor. (The fastening straps 272 and 274 are mentioned above, and described in greater detail hereinbelow.)

These features of the lamp 200—the fastening straps 272 and 274, and the pair of bottom frame braces 238—cooperate to securely hold the arc tube 210 in position (in the middle of the bulb 220), even during heavy shock and vibration.

FIG. 3A illustrates an arc tube 310 (compare 210), a top U-pin 312 (compare 212) extending from a top pinch 310*a* (compare 210*a*) of the arc tube 310, a bottom U-pin 314 (compare 214) extending from a bottom pinch 310*b* (compare 210*b*) of the arc tube 310, a top frame 332 (compare 232) having two substantially parallel legs (sides) 332*a* and 332*b* (compare 232*a* and 232*b*), a bottom frame 334 (compare 334) having two substantially parallel legs (sides) 334*a* and 334*b* (compare 234*a* and 234*b*), a pair of top pinch braces 342*a* and 342*b* (compare 242*a* and 242*b*) extending from one leg 332*a* to the other, opposed leg 332*b* of the top frame 332 across the top pinch 310*a*, a pair of bottom pinch braces 344*a* and 344*b* (compare 244*a* and 244*b*) extending from one leg 334*a* to the other, opposed leg 334*b* of the bottom frame 334 across the bottom pinch 310*b*, a top U-pin brace 372 (compare 272) extending from one leg 332*a* to the other, opposed leg 332*b* of the top frame 332, across (and may be woven through) the top U-pin 312, and a bottom U-pin brace 374 (compare 274) extending from one leg 334*a* to the other, opposed leg 334*b* of the bottom frame 334, across (and may be woven through) the bottom U-pin 314, and welds between various elements are indicated by circles, all in the manner described hereinabove with respect to FIGS. 2A and 2B.

The top U-pin 312 comprises two substantially parallel legs (sides) 312*a* and 312*b* joined by a bight portion 312*c*. As noted above, the legs 332*a* and 332*b* of the top frame 332 are also substantially parallel to one another, and the top U-pin 312 and top frame 332 may be substantially coplanar with one another. The top U-pin 312 may be referred to as a "connection element". The two legs (sides) 312*a* and 312*b* of the top U-pin 312 may each be referred to as a "wire". The two legs or wires 312*a* and 312*b* may both function as "lead wires" for the arc tube, i.e., encapsulated light source.

The bottom U-pin 314 comprises two substantially parallel legs (sides) 314*a* and 314*b* joined by a bight portion 314*c*. As noted above, the legs 334*a* and 334*b* of the bottom frame 334 are also substantially parallel to one another, and the bottom U-pin 314 and top frame 334 may be substantially coplanar with one another. The bottom U-pin 314 and bottom frame 334 may be substantially coplanar with the top U-pin 312 and top frame 332. The bottom U-pin 314 may be referred to as a "connection element". The two legs (sides) 312*a* and 312*b* of the top U-pin 312 may each be referred to as a "wire". The two legs or wires 312*a* and 312*b* may both function as "lead wires" for the arc tube, i.e., encapsulated light source. (Or, as described below with respect to FIG. 3B, if the bottom U-pin is cut, one leg may function as a lead wire and the other leg may function as a starter lead.)

The top U-pin brace (or fastening strap) 372 has two ends 372*a* and 372*b* and may be "woven" through the top U-pin 312 by passing under (behind) one leg 312*a* of the U-pin 312, and over (in front of, as viewed) the other leg 312*b* of the U-pin 312 and fixed (such as welded) thereto. More particularly, the left end 372*a* of the top U-pin brace 372 may be disposed in front of and may be welded to a front surface of the left leg 332*a* of the top frame 332, then may pass under and may be welded to a back surface of the left leg 312*a* of the top U-pin 312, then may pass over and may be welded to a front surface of the right leg 312*b* of the top U-pin 312, and the right end 372*b* of the top U-pin brace 372 may be disposed behind and may be welded to the bottom surface of the right leg 332*b* of the top frame 332. "Left" and "right" refer to the positions of elements in the figure, and the welds are indicated by dots (circles). As used herein, "front" and "back" are relative terms, simply designating two opposite surfaces of an element (such as the U-pin legs or frame legs).

In a similar manner, the bottom U-pin brace (or fastening strap) 374 has two ends 374*a* and 374*b* and may "woven" through the bottom U-pin 31*b* by passing under (behind) one leg 314*a* of the U-pin 314, and over (in front of, as viewed) the other leg 314*b* of the U-pin 314 and fixed (such as welded) thereto. More particularly, the left end 374*a* of the bottom U-pin brace 374 may be disposed in front of and may be welded to a front surface of the leg 334*a* of the bottom frame 334, then may pass under and may be welded to a back surface of the left leg 314*a* of the bottom U-pin 314, then may pass over and may be welded to a front surface of the right leg 314*b* of the bottom U-pin 314, and the right end 374*b* of the bottom U-pin brace 374 may be disposed behind and may be welded to the bottom surface of the right leg 334*b* of the bottom frame 334. "Left" and "right" refer to the positions of elements in the figure, and the welds are indicated by shaded dots. As used herein, "front" and "back" are relative terms, simply designating two opposite surfaces of an element (such as the U-pin legs or frame legs).

A benefit of the woven configuration of the top and bottom U-pin braces 372 and 374 through the legs (sides) of the top and bottom U-pins 312 and 314, respectively, may be that even if both welds on a given U-pin fail, such as a result of shock or vibration, adequate contact surface area and contact pressure between the brace (372, 374) and the U-pin (312, 314) may remain to maintain electrical conduction for continued operation of the lamp.

A person of ordinary skill in the related lamp-making and design arts will understand that the references herein to "U-pin brace" (or fastening strap) can take a variety of forms (e.g., 1 or 2 ribbons or wires) which are mechanically bonded (such as welded) to both sides of the frame plus the lead wire or wires (such as a U-pin) that extend out of the arc tube pinch (end).

Adding extra fastening straps (top and/or bottom U-pin braces) creates a much stronger mount structure that compensates for the lack of continuous vertical (longitudinal) frame side wires (contrast U.S. Pat. No. 3,623,134) by providing two longitudinally spaced-apart connections between each arc tube end and the corresponding top/bottom U-shaped frame. The top end 310*a* of the arc tube 310 is supported by pinch braces 342*a/b* and fastening strap(s) 372. The bottom end 310*b* of the arc tube 310 is supported by pinch braces 344*a/b* and fastening strap(s) 374.

In essence, the single pivot point of the pinch strap welded to both sides of a frame, as shown in the lamp 100, is eliminated (supplanted) by adding a second fastening strap welded to both sides of the frame and longitudinally spaced apart from the pinch strap.

The extra fastening straps (top and/or bottom U-pin braces) are positioned for welding to the arc tube leads (such as in the form of U-pins) extending out from the arc tube end, thereby securely holding the arc tube in alignment with a longitudinal axis in the middle of the bulb (determined by the plane of the frame which is attached in two places to the arc tube end and leads), even during heavy shock and vibration.

Regarding the construction of the arc tube leads, as described herein, the arc tube leads may be in the form of U-pins. This is readily implemented in a pulse start lamp which has intact U-pins extending from both arc tube ends (pinches). For a probe-start type lamp, two separate leads are needed at one (typically the bottom) end of the arc tube. The bottom leads may be formed separately by cutting (clipping) a U-pin type lead.

Although using a pulse start lamp with the bottom U-pin intact may provide better structural strength (by weaving through and welding to both sides of a U-pin), lesser but still significant improvement should result from implementing the top U-pin brace and the bottom frame brace, but without the bottom U-pin brace when a starter lead must be used. Alternatively, strength will be even better if the bottom U-pin brace's strap that extends between both sides of the frame is still welded to the bottom arc tube lead, and the only difference then being that the starter lead (cut away from the electrode lead) would be bent away from the U-pin brace to make a separate electrical connection as required.

This also exemplifies a novel embodiment that can be applied to lamps having individual lead wire(s) into an arc tube pinch (not a U-pin). In this case, the improvement over prior art includes having a strap like the U-pin brace's strap 272, 274 that is welded to an individual arc tube lead plus two opposed sides of the frame 232, 234.

The example shown in FIG. 3A is representative of a pulse-start type HID lamp. For a probe-start type HID lamp (described below with FIG. 3B), the bottom U-pin may be cut (or clipped, such as in half, at the bight) so that one leg of the bottom U-pin constitutes an "electrode lead wire", and the other leg is a "starter lead wire" connected to a probe wire for starting the discharge in the arc tube.

FIG. 3B illustrates an embodiment of a semi-woven bottom U-pin brace structure for a probe-start type HID lamp. Only a relevant portion of the lamp is shown, namely an arc tube 310, a bottom U-pin 316 (which is cut, as described below) extending from a bottom pinch 310*b* of the arc tube 310, a bottom frame 334 having two substantially parallel legs (sides) 334*a* and 334*b*, a pair of bottom pinch braces 344*a* and 344*b* extending from one leg 334*a* to the other leg 334*b* of the bottom frame 334 across the bottom pinch 310*b*, and a bottom U-pin brace 376 (compare 374) extending from one leg 334*a* to another leg 334*b* of the bottom frame 334, across the bottom U-pin 316. Welds between various elements are indicated by circles in the manner described hereinabove.

The U-pin 316 may be referred to as a "connection element". Similar to the U-pin 314 (FIG. 3A), the U-pin 316 (FIG. 3B) has two legs 316*a* and 316*b*. In contrast with the bottom U-pin 314 (FIG. 3A), the U-pin 316 (FIG. 3B) has been cut (or clipped, such as in half, at the bight) so that one leg 316*a* of the bottom U-pin constitutes an "electrode lead wire" (or "bottom electrode lead"), and the other leg 316*b* is electrically independent therefrom and may be used as a "starter lead wire" (or "probe lead", or "starter wire", or "probe wire"). (Of course, the two legs 316*a* and 316*b* could be formed independently as two elements, rather than by cutting one element.)

The legs (sides) 334*a* and 334*b* of the bottom frame 334 are substantially parallel to and coplanar with one another, and the lead wire leg 316*a* of the cut U-pin 316 is substantially coplanar with the two legs 334*a* and 334*b*. The other, probe lead leg 316*b* of the cut U-pin 316 is bent, out-of-plane, so that the bottom U-pin brace 376 can pass by it without touching it, remaining electrically isolated therefrom.

The bottom U-pin brace (or fastening strap) 376 has two ends 376*a* and 376*b* and may be "woven" by passing under (behind) one leg 316*a* of the U-pin 316 and being fixed (such as welded) thereto. More particularly, the left end 376*a* of the bottom U-pin brace 376 may be disposed in front of and may be welded to a front surface of the left leg 334*a* of the bottom frame 334, then may pass under and may be welded to a back surface of the lead wire leg 316*a* (which is the left leg) of the bottom cut U-pin 316, pass by without contacting the starter lead (which is the right leg) of the bottom cut U-pin 316, and the right end 376*b* of the bottom U-pin brace 376 may be disposed in front of and may be welded to a front surface of the right leg 336*b* of the bottom frame 334.

The top U-pin brace 372 may be woven through the two legs 312*a* and 312*b* of the top U-pin 312, in the manner described hereinabove (reference FIG. 3A). The bottom U-pin brace 376 is "woven" (in a manner of speaking) through only one leg 316*a* of the bottom U-pin 316, the other leg 316*b* being bent out of the way (out of plane).

Because of the "woven" (in and out of plane) configuration of the top U-pin brace 372 through the top U-pin 312, and the bottom U-pin brace 374 (FIG. 3A) or 376 (FIG. 3B) through the bottom U-pins 314 or 316, respectively, even if one or both welds on a given U-pin fail, such as a result of shock or vibration, adequate (sufficient) contact surface area and contact pressure (due to the "weaving") between the brace and the respective U-pin may remain to maintain electrical conduction between the U-pin brace and the respective U-pin for continued operation of the lamp.

When the legs of any of the U-pins (212, 214, 312, 314, 316) referred to herein are referred to as "wires", it should be understood that they may be substantially rigid wires performing a mechanical function of supporting the arc tube (210, 310) in addition to their electrical function of carrying current into the arc tube (210, 310).

The bottom frame 334 may be connected to a stem lead (264, FIG. 2) and a fly wire (268, FIG. 2) may be connected to the other stem lead (262, FIG. 2). The probe (starter) lead leg 316*b* of the bottom cut U-pin 316 may be connected to a starting circuit 380 (illustrated schematically), which may be also be connected by a lead 382 to the other stem lead (262, FIG. 2).

Several and various elements and aspects of an improved, ruggedized lamp mount structure have been disclosed, including but not limited to top and/or bottom U-pin braces and bottom frame braces.

While the invention has been described with respect to a limited number of embodiments, these should not be construed as limitations on the scope of the invention, but rather as examples of some of the embodiments. Those skilled in the art may envision other possible variations, modifications, and implementations that are also within the scope of the invention, based on the disclosure(s) set forth herein.

What is claimed is:

1. A ruggedized lamp, wherein the lamp comprises an encapsulated, two-ended light source supported by a mount structure inside a bulb, the mount structure further comprising a discontinuous two-part frame wherein a top end portion of the light source is mounted in a top part of the two-part frame and a bottom end portion of the light source is mounted in a bottom part of the two-part frame, wherein:

the top end portion of the light source is secured by at least one pinch strap attached to, and extending between, two sides of the top part of the two-part frame at a first longitudinal position on the two sides of the top part of the two-part frame;

the bottom end portion of the light source is secured by at least one pinch strap attached to, and extending between, two sides of the bottom part of the two-part frame at a first longitudinal position on the two sides of the bottom part of the two-part frame;

the ruggedized lamp further comprising:

a top strap fixed to, and extending between, two sides of the top part of the two-part frame at a second longitudinal position on the two sides of the top part of the two-part frame, and therebetween crossing and being fixed to a top connection element comprising at least one wire extending from the top end portion of the light source; and a bottom strap fixed to, and extending between, two sides of the bottom part of the two-part frame at a second longitudinal position on the two sides of the bottom part of the two-part frame, and therebetween crossing and being fixed to a bottom connection element comprising at least one wire extending from the bottom end portion of the light source.

2. The ruggedized lamp of claim 1, wherein:

at least one of the top and bottom connection elements comprises two wires extending substantially in parallel with one another from the at least one end portion of the light source.

3. The ruggedized lamp of claim 2, wherein:

the strap extending across the at least one of the top and bottom connection elements extends across a front surface of one of the two wires and across a back surface of the other of the two wires.

4. The ruggedized lamp of claim 2, wherein:

the strap is woven through the two wires of the connection element.

5. The ruggedized lamp of claim 1, wherein:

at least one of the top and bottom connection elements comprises a U-pin.

6. The ruggedized lamp of claim 1, wherein:

one of the top and bottom connection elements comprises a cut U-pin.

7. The ruggedized lamp of claim 6, wherein:

the cut U-pin comprises two lead wires of the encapsulated light source, one of which is an electrode lead wire, the other of which is a starter probe lead wire.

8. The ruggedized lamp of claim 1, wherein:

the light source comprises an arc tube.

9. The ruggedized lamp of claim 1, wherein:

the lamp comprises a high intensity discharge (HID) lamp.

10. The ruggedized lamp of claim 9, wherein:

the HID lamp is a pulse-start type lamp.

11. The ruggedized lamp of claim 9, wherein:

the HID lamp is a probe-start type lamp.

12. The ruggedized lamp of claim 1, further comprising:

a top frame brace extending from a third longitudinal position of the top part of the two-part frame to an inside wall of the bulb in a dome portion of the bulb; and a bottom frame brace extending from a third longitudinal position of the bottom part of the two-part frame to an inside wall of the bulb in a neck portion of the bulb.

13. The ruggedized lamp of claim 12, wherein:

the bottom frame brace comprises a pair of braces, one extending from a first side of the bottom part of the two part frame, and another one extending from a second side, opposite the first side, of the bottom part of the two part frame.

14. A lamp comprising an encapsulated, two-ended light source supported by a mount structure within a bulb, the mount structure comprising:

a top frame having two substantially parallel legs extending adjacent opposite sides of a top portion of the light source;

a bottom frame having two substantially parallel legs extending adjacent opposite sides of a bottom portion of the light source;

a top pinch strap extending from a first position on the legs of the top frame and securing the top portion of the light source;

at least one bottom pinch strap extending from a first position on the legs of the bottom frame and securing the bottom portion of the light source;

a top bracing strap extending from a second position on the legs of the top frame and fixed to at least one wire extending out of the top portion of the light source; and a bottom bracing strap extending from a second position on the legs of the bottom frame and fixed to at least one wire extending out of the bottom portion of the light source.

15. The lamp of claim 14, wherein:

at least one of the top and bottom portions of the light source comprises two wires extending substantially in parallel with one another from the at least one of the top and bottom portions of the light source; and the bracing strap that is fixed to one of the two wires is also fixed to the second one of the two wires.

16. The lamp of claim 15, wherein:

the two wires comprise a U-pin.

17. The lamp of claim 15, further comprising:

a top frame brace extending from a third position on the legs of the top frame to an inside wall of the bulb in a dome portion of the bulb; and a bottom frame brace extending from a third position on the legs of the bottom frame to an inside wall of the bulb in a neck portion of the bulb.

18. A method of ruggedizing a lamp having a two-ended light source having a top end portion and a bottom end portion, a top frame having two substantially parallel legs disposed adjacent the top end portion of the light source, a bottom frame having two substantially parallel legs disposed adjacent the bottom end portion of the light source, at least one wire extending from the top end portion of the light source, and at least one wire extending from the bottom end portion of the light source, the method comprising:

providing top pinch straps extending from leg-to-leg between the legs of the top frame across the top end portion of the light source and securing it to the top frame;

providing bottom pinch straps extending from leg-to-leg between the legs of the bottom frame across the bottom end portion of the light source and securing it to the bottom frame;

providing a top bracing strap extending from leg-to-leg between the legs of the top frame across the at least one wire extending from the top end portion of the light source; and providing a bottom bracing strap extending from leg-to-leg between the legs of the bottom frame across the at least one wire extending from the bottom end portion of the light source.

19. The method of claim 18, wherein the at least one wire extending from at least one of the top and bottom end portions of the light source comprises two wires which are substantially coplanar with one another and with the legs of a corresponding at least one of the top and bottom frames, and further comprising;

weaving at least one of the top and bottom bracing straps through the two wires; and fixing the at least one of the top and bottom bracing straps to the two wires.

20. The method of claim 18, wherein the lamp further comprises a bulb enclosing the light source and having a dome portion and a neck portion, and a central portion of increased diameter between the dome and neck portions, the method further comprising:

providing top frame braces extending from the top frame to stabilize the top frame in the dome portion of the bulb; and providing bottom frame braces extending from the bottom frame to stabilize the bottom frame in the neck portion of the bulb.

* * * * *